United States Patent [19]

Kinoshita et al.

[11] 4,086,104

[45] Apr. 25, 1978

[54] METHOD OF PREVENTING OXIDATION OF AUSTENITIC STAINLESS STEEL MATERIAL IN HIGH TEMPERATURE STEAM

[75] Inventors: Kazuhisa Kinoshita, Yokohama; Naoki Masamune, Kawasaki, both of Japan

[73] Assignee: Nippon Kokan Kabushiki Kaisha, Tokyo, Japan

[21] Appl. No.: 704,105

[22] Filed: Jul. 9, 1976

[30] Foreign Application Priority Data

Jul. 14, 1975 Japan ..... 50-85261

[51] Int. Cl.[2] ..... C21D 7/06

[52] U.S. Cl. ..... 148/12 E; 29/90 A; 72/53; 148/38

[58] Field of Search ..... 148/12 E, 38; 29/90 A; 72/53; 51/319, 320

[56] References Cited

U.S. PATENT DOCUMENTS

| | | | |
|---|---|---|---|
| 2,739,424 | 3/1956 | Fritze | 51/319 |
| 3,166,841 | 1/1965 | Gebhard et al. | 51/319 |
| 3,835,587 | 9/1974 | Hall, Jr. | 51/319 |
| 3,844,846 | 10/1974 | Friske et al. | 148/12 E |

*Primary Examiner*—W. Stallard

*Attorney, Agent, or Firm*—Haseltine, Lake & Waters

[57] ABSTRACT

After the completion of the final heat treatment in the manufacture of austenitic stainless steel material or after the completion of the hot rolling of the material when such final heat treatment is eliminated by a hot finish, the surface of the material which will be contacted with high temperature steam is worked by shot peening. In this way, when the material is used, for example, for a boiler superheater or reheater, the oxidation of the material in high temperature steam can be reduced considerably.

6 Claims, 9 Drawing Figures

METHOD OF PREVENTING OXIDATION OF AUSTENITIC STAINLESS STEEL MATERIAL IN HIGH TEMPERATURE STEAM

BACKGROUND OF THE INVENTION

The present invention relates to a method of preventing the oxidation of austenitic stainless steel material in high temperature steam and more particularly it relates to a method of preventing the oxidation in high temperature steam of the inner surface of a superheater tube or reheater tube for a boiler made from such material.

With recently constructed large boilers for thermal power generation, austenitic stainless steel is used as the material for the tubes of high-temperature, high-pressure steam generating superheaters or reheaters. When the material is oxidized in high temperature steam, the thickness of the scale formed on the material is far greater than that of the scale which will be formed on the material when it is heated and oxidized at the same temperature in the atmosphere and this scale grows with the time. For example, the thickness of scale formed on the inner surface of the final stage tube (SUS 321 HTB) in a superheater operated at the outlet temperature of 569° C and gauge pressure of 174 $Kg/cm^2$ is between 50 and 70 $\mu$ after one year's service and on the order of 100 $\mu$ after three year's service. This scale is usually composed of two layers of inner and outer layers with the outer layer consisting of iron oxide containing practically no such alloying elements as Cr, Ni and Mn, whereas the inner layer contains large amounts of these alloying elements in concentrated form. Because of these differences in chemical composition and physical properties between the outer and inner layers, the outer layer of the scale tends to easily break away during the stopping periods of the boiler operation as well as during the starting periods of the boiler operation. Thus, if there is a large amount of such separated scale, the separated scale accummulates in the tubes with the resulting clogging of the tubes at the bends, etc., or the separated scale is carried away from the tubes by a high velocity stream of steam causing abnormal wear of the various valves and turbine blades.

Particularly, in the case of a suspension type superheater, the scale tends to accumulate in the lower bend portions with the result that the accumulated scale obstructs the flow of steam and the temperature of the tube walls increases abnormally thus involving the danger of causing a bursting boiler failure. In an attempt to prevent the occurrence of such failures, presently a difficult operation has been employed in which the clogging of the tubes by the scale is detected by means of a $\gamma$ ray inspection during the periodic inspection so that any tube portions with a large amount of accumulated scale is cut off thus removing the scale and clearing the tubes and then the cut off tube portions are rejoined by welding. With such a troublesome operation, it is still impossible to completely prevent the occurrence of bursting boiler failure. Further, such failure may also be caused by abnormal wear of the valves, etc., due to the scale conveyed along with the flow of steam and therefore the accumulation of separated scale due to oxidation of the tubes involves the danger of causing a serious damage. However, no practical method of effectively preventing the formation of scale has been put in use as yet.

SUMMARY OF THE INVENTION

It is an object of this invention to provide a method of preventing the oxidation of austenitic stainless steel material in high temperature steam thus reducing the formation of scale to prevent failure of a boiler and preventing the occurrence of residual tensile stresses.

In accordance with the present invention, there is thus provided a method of preventing the oxidation of austenitic stainless steel material in high temperature steam, wherein after the final heat treatment operation in the manufacturing process of austenitic stainless material or after the hot rolling operation when the final heat treatment is eliminated by a hot finish, the surface of the material which will be exposed to high temperature steam is worked by shot peening thus improving the resistance of the material to oxidation in high temperature steam. According to a preferred embodiment of this invention, the surface of austenitic stainless steel material is worked by shot peening in such a manner that the depth of peening worked zone is over 10 $\mu$. To obtain the peening worked zone of over 10 $\mu$ depth, the peening of the material is accomplished by using shot of carbon steel, alloy steel or stainless steel material with the following conditions: shot blasting pressure, 4.0 $Kg/cm^2$ or over; weight of blasted shot, 0.023 $Kg/cm^2$.min or over.

DETAILED DESCRIPTION OF THE INVENTION

The depth of the peening worked zone is related to the hardness of the peening shot and the hardness of the shot should preferably be equal to or greater than that of austenitic stainless steel material to be worked in order to obtain the peening worked zone of a sufficient depth. The material for the peening shot used with the method of this invention is carbon steel, alloy steel or stainless steel.

Figure 1:
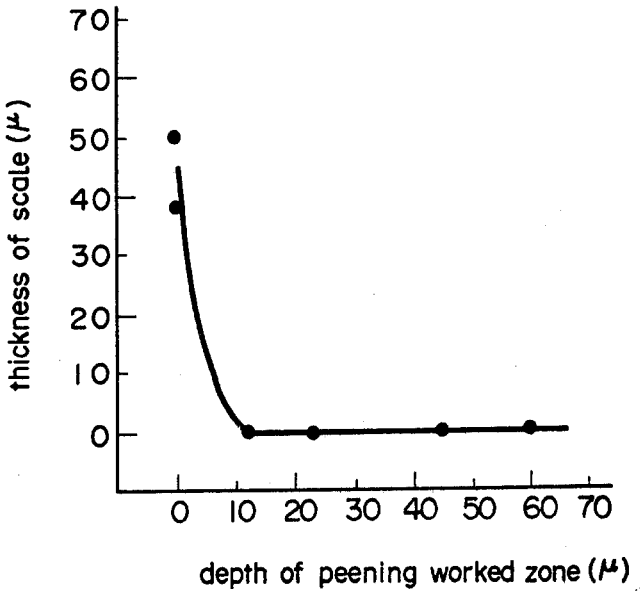
FIG. 1 is a diagram showing the relationship between the depth of peening worked zone and the thickness of scale formed by the oxidation of material in high temperature steam (in 1000 hours at 700° C).

Referring now to FIG. 1, there is shown the relationship between the thickness of the scale formed by oxidizing austenitic stainless steel material for 1000 hours in high temperature steam at 700° C and the depth of the peening worked zone. Therefore, in order to provide the material with a sufficient oxidation resistance in high temperature steam, it is essential to work the material in such a manner that the peening worked zone has a uniform depth of about 10 $\mu$ or over. Further, as shown in FIGS. 2 and 3, the depth of peening worked zone is affected by the weight of blasted shot and the shot blasting pressure.

Figure 2:
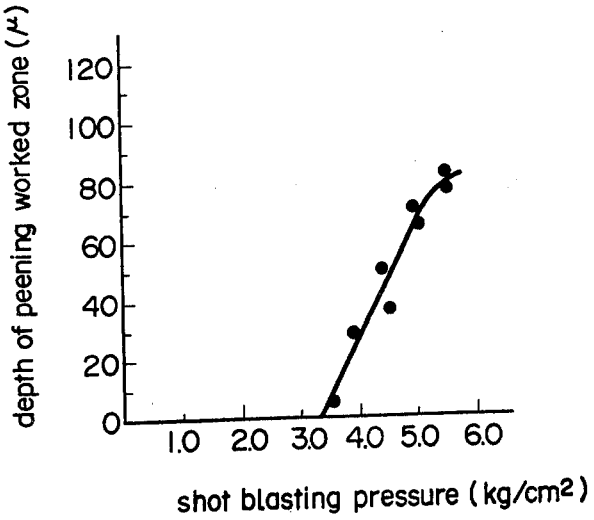
FIG. 2 is a diagram showing the relationship between the shot blasting pressure and the depth of peening worked zone when the weight of blasted shot was held at a constant value of 0.041 $Kg/cm^2$.min.
Figure 3:
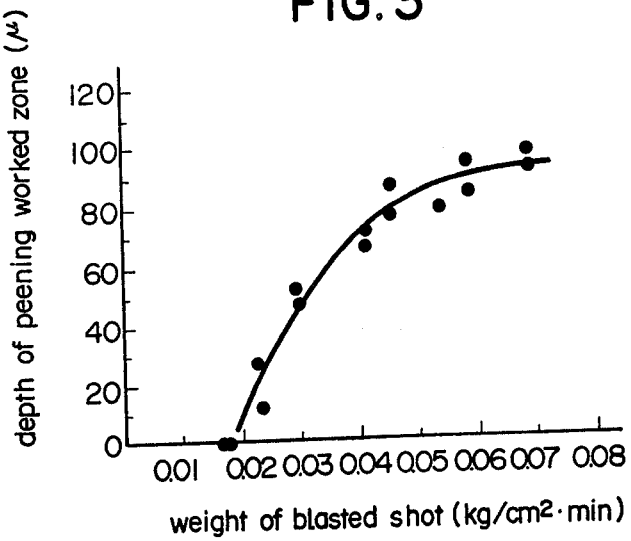
FIG. 3 is a diagram showing the relationship between the weight of blasted shot and the depth of peening worked zone when the shot blasting pressure was held at a constant value of 5 $Kg/cm^2$.

As will be seen from FIG. 2, if the shot blasting pressure is less than 4.0 Kg/cm$^2$, then the depth of the resulting peening worked zone will be inadequate thus failing to ensure the peening worked zone of a sufficient depth. On the other hand, as will be seen from FIG. 3, where the weight of the blasted shot is less than 0.023 Kg/cm$^2$.min, then the resulting worked zone will be markedly nonuniform and in extreme cases some portions of the material will have no peening worked zone. These limited values for the shot blasting pressure and the weight of blasted shot are extremely critical with the result that if, for example, the shot blasting pressure is less than the previously mentioned pressure, the desired depth of the peening worked zone cannot be obtained even if the weight of the blasted shot is as high as about two times the critical value, whereas if the weight of the blasted shot is less than the above-mentioned critical value, it is impossible to obtain the desired uniform depth of the peening worked zone even if the shot blasting pressure is higher than the critical value by 20 to 30%.

Further, since the use of a heat treatment or hot working after the peening operation tends to cancel or reduce the effect of the peening process which was effected on purpose by the effectuation of the treatment, in accordance with the method of this invention the time of the peening operation is selected so that the peening operation is effected after the final heat treatment or after the hot rolling when a hot finish is used.

Figure 4:
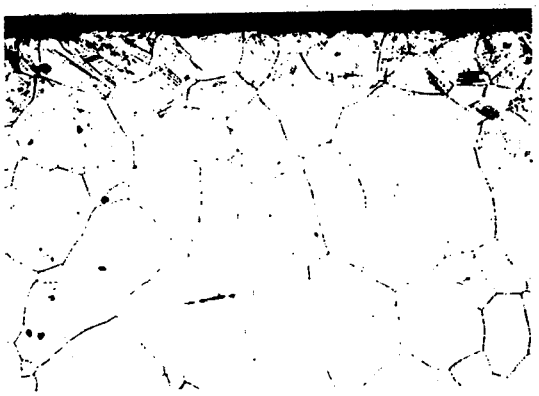
FIG. 4 is the microstructure (400 magnifications) of the peening worked zone produced with an insufficient shot blasting pressure.
Figure 5:
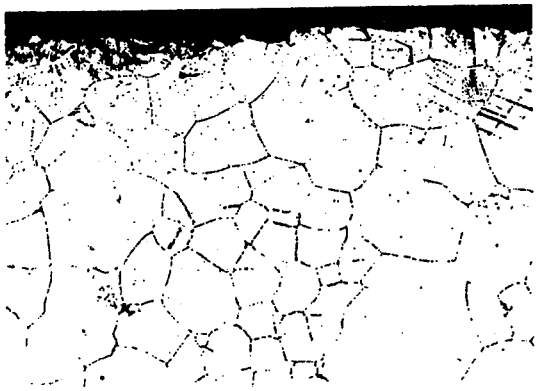
FIG. 5 is the microstructure (400 magnifications) of the peening worked zone produced with an insufficient weight of blasted shot.
Figure 6:
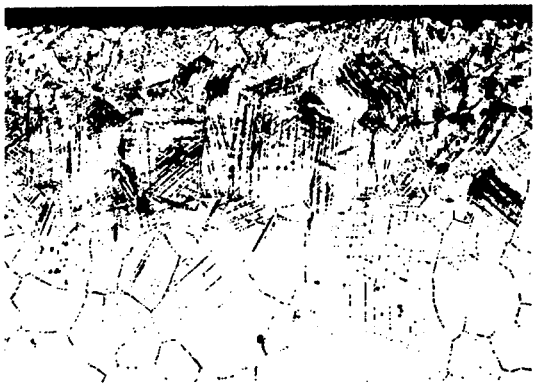
FIG. 6 is the microstructure (400 magnifications) of the peening worked zone produced when both the shot blasting pressure and the weight of blasted shot were sufficient.

FIGS. 4 through 6 show the microstructures of the austenitic stainless steel material which was subjected to the process of shot peening after the final heat treatment and the weight of the blasted shot and the shot blasting pressure were respectively 0.05 Kg/cm$^2$.min and 3.5 Kg/cm$^2$ in the case of FIG. 4, 0.02 Kg/cm$^2$.min and 5.2 Kg/cm$^2$ in the case of FIG. 5 and 0.04 Kg/cm$^2$.min and 5 Kg/cm$^2$ in the case of FIG. 6. It will be seen that the depth of the peening worked zone was insufficient and nonuniform in the case of FIG. 4 where the shot blasting pressure was less than the critical value and in the case of FIG. 5 where the weight of the blasted shot was less than the critical value, whereas where both the weight of the blasted shot and the shot blasting pressure were above their cirtical values, the resulting peening worked zone had a uniform and sufficient depth as shown in FIG. 6.

With the method of this invention, austenitic stainless steel material is worked by shot peening in the above-described manner and thus oxidation of the austenitic stainless steel material in high temperature steam can be reduced considerably.

Thus, the effect of this invention is so great that the formation of scale is practically inhibited and consequently the occurrence of such serious accidents as the bursting of the boiler due to the accumulation of separated scale can be prevented. Further, the peening process of this invention is capable of working a large number of steel tubes uniformly and efficiently.

Generally, when water enters and evaporates in the tube such as the superheater tube for the boiler using austenitic stainless steel tube upon stopping the operation of a boiler or during a hydraulic pressure test or the like a very small amount of corrosive substance is left in the tube and this substance causes stress corrosion cracking of the tube. In the case of other surface treatment processes employing a grinder, cutting operation, etc., residual tensile stresses are left in the surface of the tube and if this steel tube is used in such a case, stress corrosion cracking of the tube is very easily caused leading to a serious accident. On the contrary, the method of this invention leaves no local residual tensile stresses and thus there is no danger of such accident. Thus, the present invention has a very high industrial utility value.

DESCRIPTION OF THE PREFERRED EMBODIMENTS

The inner surface of a stabilized austentitic stainless steel tube (SUS 321 HTB.18-8 Ti) having an outer diameter of 38.1 mm and wall thickness of 6.7 mm was worked by shot peening, installed in a boiler and the formation of the scale on the inner surface of the tube was inspected at the expiration of one year and three years, respectively. The peening operation was accomplished by using the steel shot which were shoot through a nozzle of 6 mm diameter at an angle of 45° and by moving the nozzle in the lengthwise direction of the tube while rotating the latter.

For purposes of comparison, part of the tube inner surface was left unworked by shot peening, that is to say, as it stands in the state of solid solution.

Figure 7:
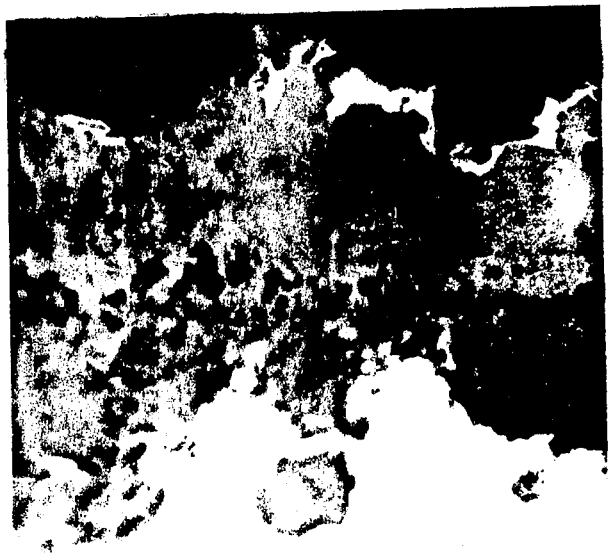
FIG. 7 is the microstructure (800 magnifications) after one year's service of the inner side cut area of the steam pipe produced without employing the method of this invention.
Figure 9:
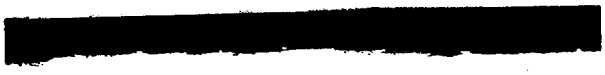
FIG. 9 is the microstructure (800 magnifications) after three year's service of the inner side cut area of the steam pipe produced by employing the method of this invention.
Figure 8:
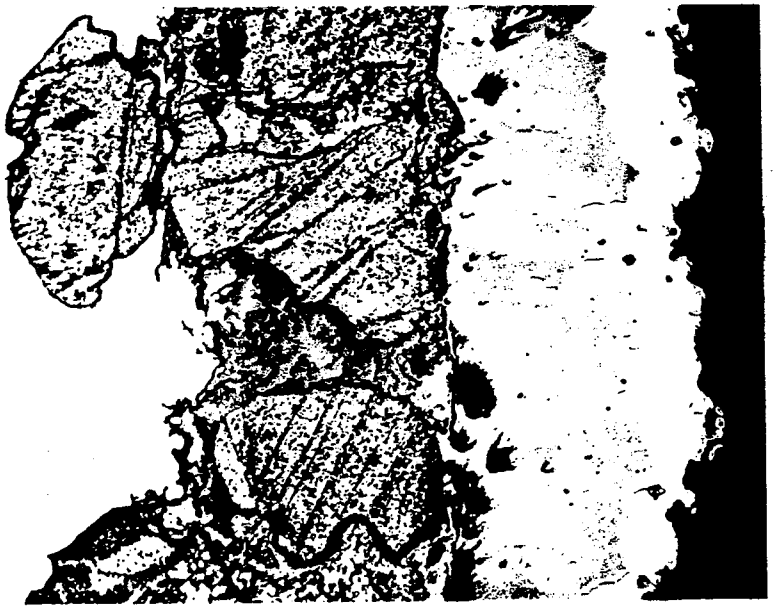
FIG. 8 is the microstructure (800 magnifications) after three year's service of the inner side cut area of the steam pipe produced without employing the method of this invention.

The experimental tube was installed in the vicinity of the final stage superheater outlet (the temperature was 569° C) of the boiler operated at the pressure of 173.6 Kg/cm$^2$. When the boiler was run for one year and three years, respectively, the experimental tube was cut to obtain samples and the sections of the samples were examined under a microscope. As will be seen from the microphotographs, the thickness of the scale formed on the unworked portion was about 100 $\mu$ (FIG. 7) after one year's run and about 140 $\mu$ (FIG. 8) after three year's run and the scale was composed of two layers or three layers with the addition of the outermost layer. The outer layers were very easily separable. On the contrary, as will be seen from FIG. 9, only a thin layer of scale was formed even at the end of the third year on the tube portion which was worked in accordance with the method of this invention and this thin scale was not measurable under a microscope of 800 magnifications. While the observation of the surface with the unaided eye showed that the surface was black in color and the surface was apparently covered with the scale, the scale was as thin and dense as comparable with that which is formed on the surface of stainless steel heated in air and it is presumed that this fact contributed in preventing the growth of the scale.

What we claim is:

1. A method of preventing scale formation by surface oxidation of stabilized austenitic stainless steel material in high temperature dry steam, comprising subjecting the surface of a stabilized austenitic stainless steel material which will be contacted with high temperature dry steam to shot peening after the final heat treatment operation in the manufacturing process of said material or after the hot rolling of said material when said final heat treatment operation is eliminated by a hot finishing operation, the now, shot-peened stabilized austentitic stainless steel being usable in an atmosphere of high temperature dry steam and being substantially free from formation of scale.

2. A method according to claim 1, wherein the depth of the zone worked by said peening shot is over 10 $\mu$.

3. A method according to claim 2, wherein said shot peening is effected by using carbon steel shot, alloy steel shot or stainless steel shot under the following conditions: shot blasting pressure, over 4.0 $Kg/cm^2$; weight of blasted shot, over 0.023 $Kg/cm^2$.min, whereby said depth of the peening worked zone of said material of over 10 $\mu$ is obtained.

4. A method according to claim 3, wherein said material is in the form of a tube, and wherein said peening is accomplished by blasting the steel shot against the inner surface of said tube at an angle of 45° while rotating said tube.

5. A method according to claim 4, wherein said tube is a high-temperature steam pipe for boiler superheaters or the like.

6. A stabilized austenitic stainless steel tube obtained by the method of claim 1 for a superheater or a reheater of a high-temperature high-pressure steam boiler, subjected to shot peening to a depth of at least 10 $\mu$.

* * * * *